United States Patent [19]

Halford et al.

[11] Patent Number: 4,519,789

[45] Date of Patent: May 28, 1985

[54] COMBINED JUMP MEANS AND TOY VEHICLE WITH SIMULATED STUNT HOOP

[75] Inventors: Wayne R. Halford, Manhattan Beach; Larry H. Renger, Hawaiian Gardens, both of Calif.; James J. Dooley, Stanley, Hong Kong

[73] Assignee: Mattel, Inc., Hawthorne, Calif.

[21] Appl. No.: 538,007

[22] Filed: Sep. 30, 1983

[51] Int. Cl.[3] ..... A63H 18/02

[52] U.S. Cl. ..... 446/444; 238/10 E; 273/369; 446/461; 446/464; 446/431; 446/476

[58] Field of Search ..... 446/429, 430, 440, 444, 446/446, 457, 459, 461, 462–464; 273/369, 370, 176 B; 238/10 R–10 F

[56] References Cited

U.S. PATENT DOCUMENTS

| | | | |
|---|---|---|---|
| 189,321 | 4/1877 | Norcross | 273/369 |
| 2,066,826 | 1/1937 | Davis | 446/461 |
| 2,716,842 | 9/1955 | Kellerman | 446/461 |
| 2,881,864 | 4/1959 | Rubenstein | 446/461 X |
| 3,419,272 | 12/1968 | Miller et al. | 273/369 X |
| 3,480,210 | 11/1969 | Perrinjaquet | 238/10 E |
| 3,621,602 | 11/1971 | Barcus et al. | 46/1 K |
| 3,708,116 | 1/1973 | Woodward | 238/10 E |
| 3,712,538 | 1/1973 | Starr et al. | 238/10 E |
| 4,092,023 | 5/1978 | Hazen | 273/26 A |
| 4,241,534 | 12/1980 | Larson et al. | 46/206 |

OTHER PUBLICATIONS

Matchbox (Lesney Products Corp.), 1970 brochure.

*Primary Examiner*—F. Barry Shay

*Attorney, Agent, or Firm*—Ronald M. Goldman; James G. O'Neill

[57] ABSTRACT

A combination toy vehicle (10), a jump (14) for the vehicle, a tower (12) holding a swinging hoop (24) having a flame design adjacent the end of the jump, and a landing ramp (16) for the vehicle. The toy vehicle includes a shift lever (110, 110A) to hold the vehicle stationary when a motor in the vehicle is wound, and which upon release, allows the vehicle to move forward over the jump, through the swinging hoop, if in motion, and land on the landing ramp thereby simulating the vehicle leaping through a flaming stunt hoop.

9 Claims, 9 Drawing Figures

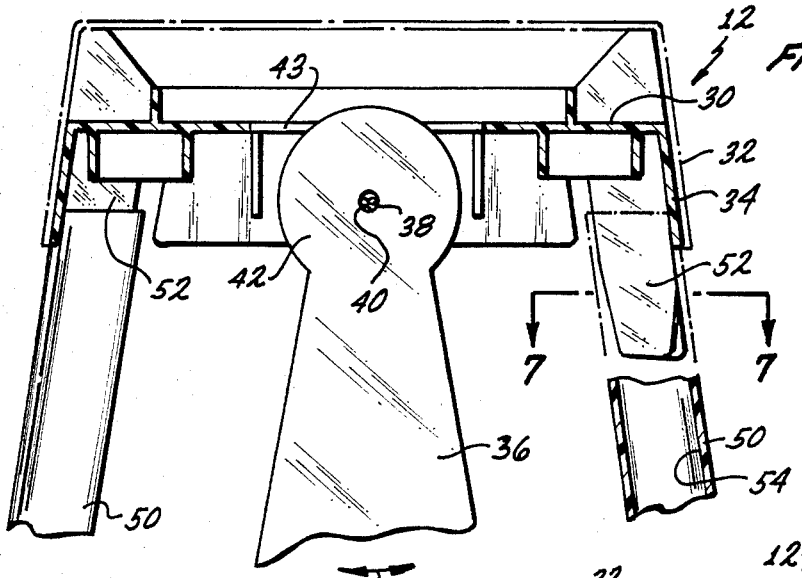
FIG. 2
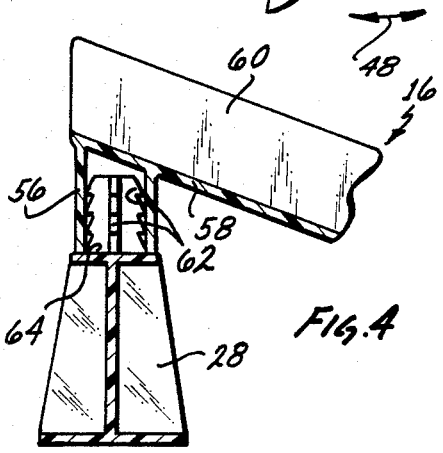
FIG. 4
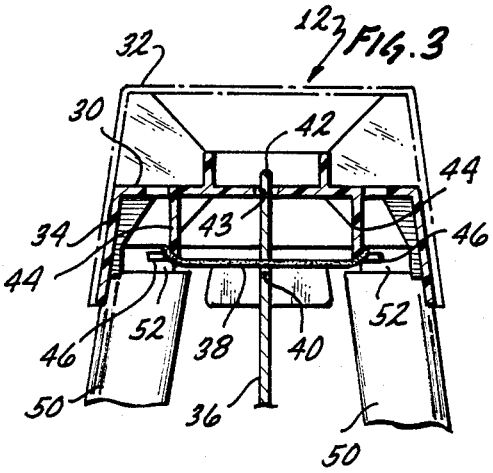
FIG. 3
FIG. 5
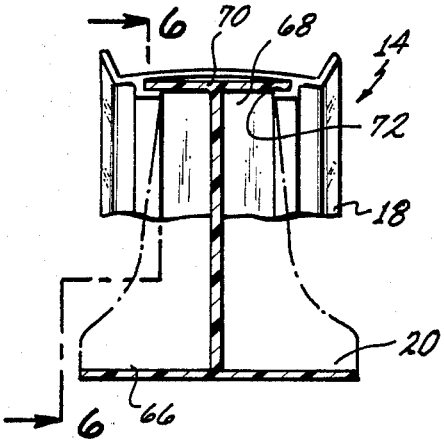
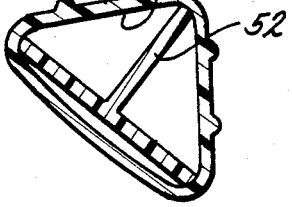
FIG. 7

COMBINED JUMP MEANS AND TOY VEHICLE WITH SIMULATED STUNT HOOP

DESCRIPTION

1. Technical Field

The present invention relates generally to toy vehicles and accessories for use therewith, and more particularly to an improved combination of a toy vehicle, a jump, and a hoop through which the toy vehicle passes.

2. Background Art

Toy vehicles, both powered and gravity actuated that traverse track systems, or pass over jumps and through obstacles are very popular. In order to increase the play value of track systems, and in turn to make them more saleable, many accessories may be added thereto, such as loop-the-loop tracks, jumps, lap counters and the like. One such accessory, is shown in U.S. Pat. No. 3,621,602 assigned to Mattel, Inc., the assignee of the present invention. This patent discloses a hoop or ring attached to the end of a jump ramp attached to a track, and provided with an insert of flexible material imprinted with a flame pattern and cut so as to deflect outwardly to allow a toy vehicle to pass therethrough, thereby simulating a vehicle leaping or driving through flames.

DISCLOSURE OF THE INVENTION

In accordance with the present invention, there is provided in combination, a toy vehicle having a shift mechanism, an adjustable height jump, and a swinging pendulum action hoop having an opening therein placed adjacent the adjustable height jump. The toy vehicle passes through an opening in the swinging hoop if the height of the jump, the space between the jump and the hoop, and the speed of the toy vehicle are properly coordinated and timed by operating the shift mechanism of the toy vehicle at the proper moment during the swing of the hoop to thereby release the toy vehicle on the jump.

BRIEF DESCRIPTION OF THE DRAWINGS

FIG. 2 is a partial sectional view taken along line 2—2 of the swinging hoop tower shown in FIG. 1;

FIG. 3 is a partial sectional view taken along line 3—3 of the swinging hoop tower shown in FIG. 1;

FIG. 4 is a partial sectional view taken along line 4—4 of the landing ramp shown in FIG. 1;

FIG. 5 is a sectional view taken along line 5—5 of the adjustable height jump shown in FIG. 1;

FIG. 7 is a sectional view taken along line 7—7 of FIG. 2;

BEST MODE FOR CARRYING OUT THE INVENTION

Figures 1, 9:
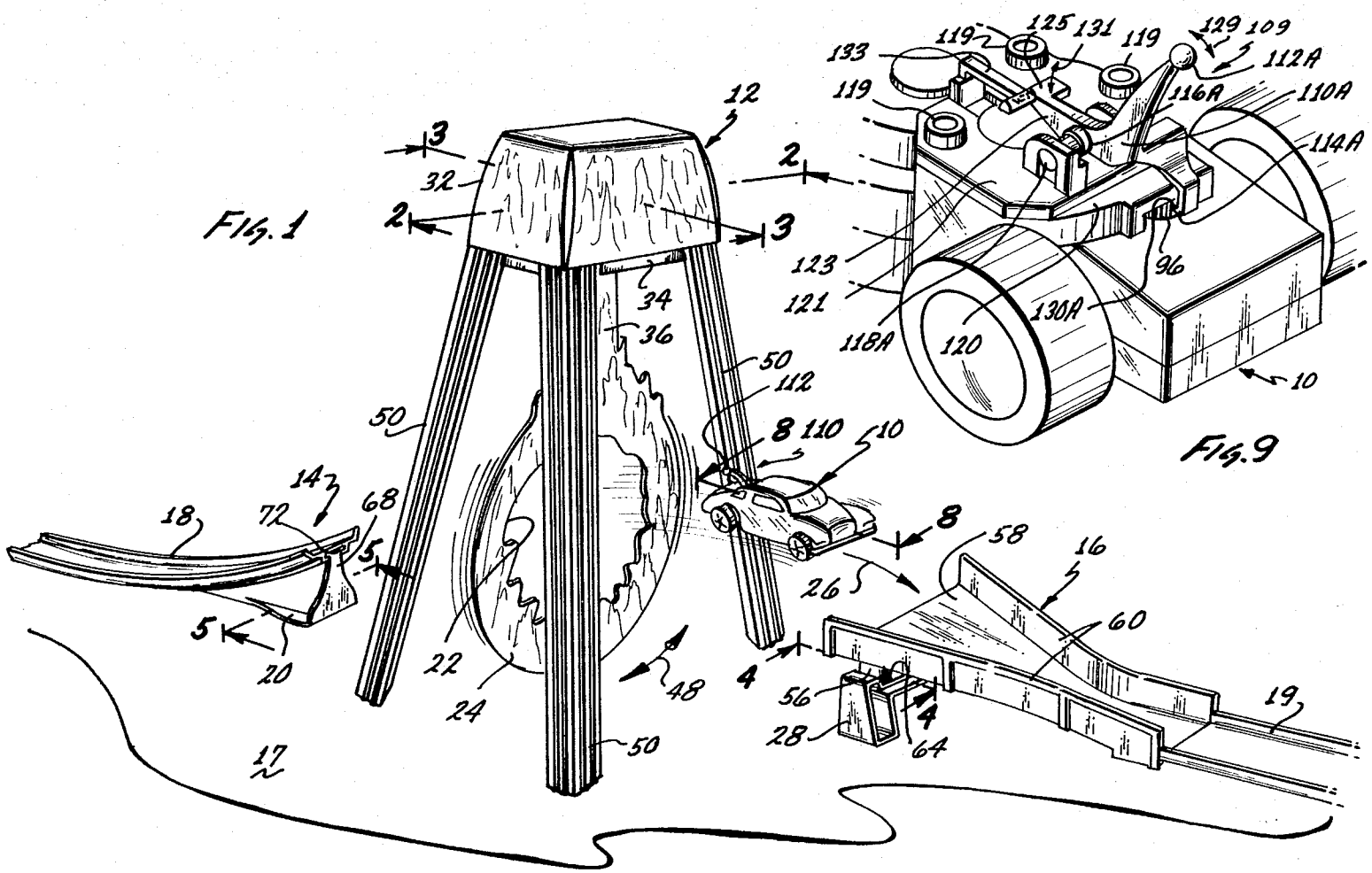
FIG. 1 is a perspective view of the combination toy vehicle, adjustable height jump, swinging pendulum hoop tower, and optional landing ramp of the present invention.
FIG. 9 is a perspective view showing a modified shift mechanism for the toy vehicle.

Referring now to the drawings, and particularly, FIG. 1, there shown is a toy vehicle 10, a swinging pendulum action hoop means 12, an adjustable height jump 14, and an optional landing ramp 16. As shown more clearly in FIGS. 5 and 6, the adjustable height jump 14 is comprised of a section of track 18, preferably flexible, adjustably supported by a ramp 20. The vehicle 10, after leaving the track 18 at the end of the jump 14, is timed to pass through an opening 22 formed in a swinging, simulated stunt hoop 24, preferrably decorated or imprinted to appear as a ring of fire. That is, a simulated flame pattern is imprinted on the hoop 24 around the opening 22 so that it gives the appearance or illusion of a ring of fire through which the vehicle jumps or passes. After passing through the opening 22, the vehicle continues in the direction of the arrow 26 to land on the ground or surface 17, or, as shown in FIG. 1, the landing ramp 16. If desired, the vehicle may then continue along a further section of track 19 for further jumps, or the like. The landing ramp 16 is elevated above the ground or surface by a trestle 28 with the lower portion of the ramp 16, adjacent the surface 17, being connected to the track 19 by a tang, or the like.

The swinging, simulated stunt hoop means 12 is shown in FIGS. 1, 2, 3, and 7 as a tower having a substantially rectangular top 30 with a removeable cover 32 fitted over the top and held against a downwardly extending outer edge portion 34 fixed to the top. The hoop 24 is formed at the lower end of a pendulum having an arm 36, and an enlarged upper end portion 42, suspended over a flexible support means 38, such as a rubber band, or the like. Support means 38 is passed or threaded through a small hole 40 formed in the enlarged upper end portion 42. The enlarged upper end portion 42 of the pendulum is captured within a slot 43 formed centrally in the top 30. After passing through the central hole 40, the support means 38 is stretched over and fixedly held to a pair of posts 44 fixed to and extending downwardly from the lower surface of top 30 on both sides of the pendulum. Each of the posts is provided at its lower end with an outwardly extending tab 46 to retain one end of the support means on each post. The hoop 24 is capable of being moved or oscillated in a pendulum-type action in the direction of the arrow 48, between leg members 50 which support the top 30 at its four corners. Each of the leg members 50 is preferrably formed in the shape of hollow triangle (FIG. 7), and is fitted over a downwardly extending holding means 52 formed integrally at each of the four corners of top 30. The downwardly extending holding means 52 are preferrably formed as extended T-shapes and fit snugly within the hollow interior 54 of each of the legs 50.

The hoop 24, when pushed by the hand or fingers of a user, moves in a pendulum-type action to twist the flexible support means 38. This twisting of the support means, together with the weight of the entire pendulum keeps the hoop in motion, in the direction of arrow 48, while the pendulum gradually loses momentum and eventually comes to a stop.

Referring now to FIG. 4, the optional landing ramp 16 is shown attached to the trestle 28 by a downwardly extending hollow portion 56 fixed to the bottom surface 58 of the landing ramp. The landing ramp also includes two tapered, upwardly extending side edge portions 60. Portion 56 is inserted over and securely held in upwardly extending serrated portions 62 (one of which is shown) fixed to a top surface 64 of the trestle 28.

Figure 6:
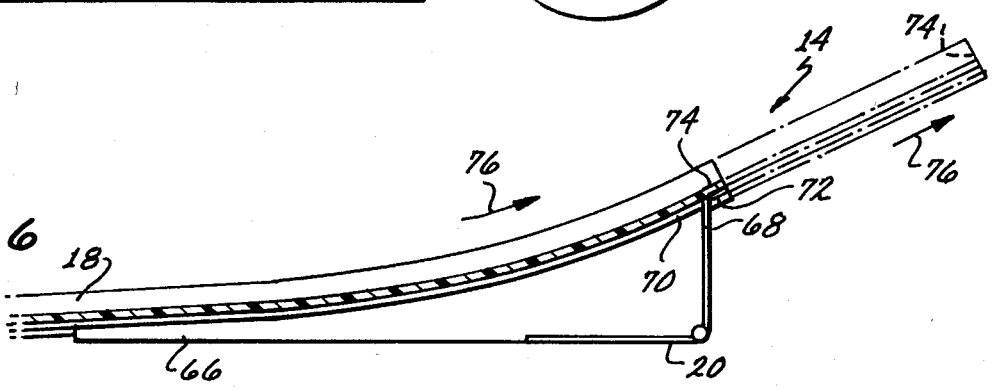
FIG. 6 is a partial side elevational view of the adjustable height jump.

FIGS. 5 and 6 show in greater detail, the adjustable height jump 14 including the flexible track 18 and supporting ramp 20. The supporting ramp 20 has a lower end 66 at ground level, and an elevated end 68 connected to the lower end by an upper surface 70, in any desired shape, such as a T, or the like. Upper surface 70 is slideably received in a continuous open channel 72 formed with or fixed to the lower surface of the flexible track 18. The track 18 includes an outer end 74 shown in FIGS. 1 and 6 in its lowered position, adjacent the elevated end 68 of the ramp 20. In FIG. 6, the track 18 and end 74 are also shown in phantom line elevated or pushed upwardly from the ramp 20. End 74 is pushed, or pulled, in the direction of arrows 76, beyond the elevated end 68 of the ramp 20, to allow the height of the jump to be raised. In other words, the slideable mounting of track 18 and ramp 20 together, via upper surface 70 held within the open channel 72, permits the track 18 and the ramp 20 to be moved or slid with respect to each other to different relative positions. Thus, the end 74 of the track may be raised or lowered relative to the end 68 of ramp 20 and the surface 17 on which it is supported. The raising or lowering of the end 74 of the track allows the jump length of the toy vehicle to be controlled when it leaves the jump. That is, the vehicle may be made to jump high or low, long or short, by merely changing the position of the end of the track relative to the elevated end 68 of ramp 20.

Figure 8:
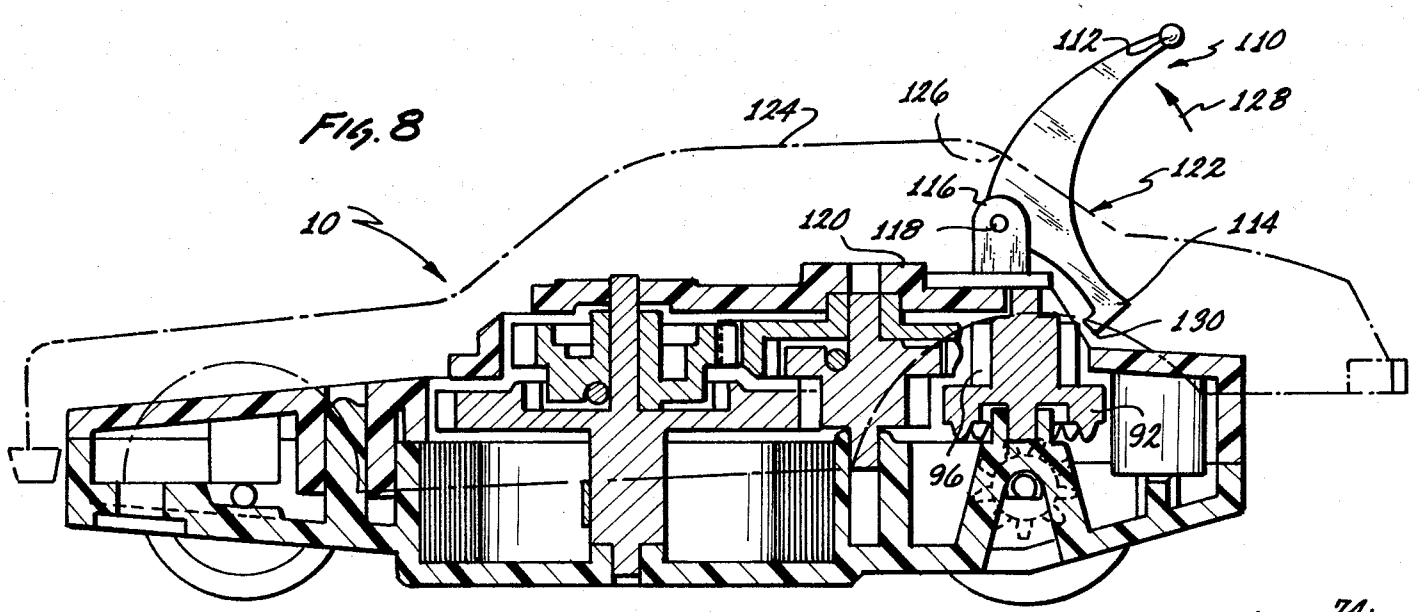
FIG. 8 is a sectional view taken along line 8—8 of the toy vehicle shown in FIG. 1.

Turning now to FIG. 8, there shown in cross section is a preferred embodiment of the toy vehicle 10 for use in combination with the adjustable height jump ramp and swinging hoop tower of the present invention. The vehicle includes a spring-drive motor of the type disclosed in U.S. Pat. No. 4,241,534 issued Dec. 30, 1980, and assigned to Mattel, Inc., the assignee of the present invention. The description and operation of the spring-drive motor set forth in U.S. Pat. No. 4,241,534 is incorporated herein by reference. The toy vehicle of U.S. Pat. No. 4,241,534, has been modified to include a shift-handle 110 with two ends 112, 114, pivotably mounted by a pivot means 116 held between the two ends, to a pivot point 118. Pivot point 118 is attached to the upper surface 120 of the spring drive motor within the vehicle 10. The handle exits through a rear portion 122 of a body shell 124 via a slot 126 formed in the body shell. The shift handle 110 is guided within slot 126. The first or outer end 112 of the shift handle is moved in the direction of arrow 128, to thereby move the shift handle to its outer or unlocked position. In its lower or locked position, the second or lower end 114, formed in the shape of a projecting finger 130, extends between adjacent gear teeth of a pinion gear 96 forming a portion of a crown gear member 92, to lock the gear, and therefore the motor. The gearing arrangement and operation of the motor is more fully described in U.S. Pat. No. 4,241,534. When the first or outer end 112 is in the upper or unlocked position, the shift mechanism 110 releases the pinion gear 96 so that, if the spring drive motor is wound, the vehicle 10 will be released, and move along a surface. The vehicle 10 is normally revved or wound up as described in U.S. Pat. No. 4,241,534, and the shift lever 110 pressed downwardly, in the direction opposite that shown by arrow 128, to lock the pinion gear 96 and therefore the spring drive motor to hold the vehicle stationary.

FIG. 9 discloses a modified shift mechanism 109 for the vehicle 10. This modified shift mechanism includes a shift-handle 110A with two ends 112A, 114A, pivotably mounted by a pivot means 116A held between the two ends to a pivot point 118A. The pivot point is held to the upper surface 120 of the spring drive motor within the vehicle 10, as by a base plate 121 fixed to the upper surface by fasteners 119. The handle may exit through a rear window area (not shown) of a body shell which may be placed over the base of the vehicle. The shift handle 110A also includes an integrally formed holding arm 123 which includes an enlarged end portion 125. When the first or outer end 112A of the shift-handle is moved in the direction of arrow 129, the enlarged end portion moves in the direction of the arrow 131, against the bias of a resilient arm 133 attached to base 121. The second or lower end 114A includes an extending finger 130A, which, in its lower or locked position, may be inserted between adjacent gear teeth of the pinion gear 96, to lock the motor.

With the first or outer end 112A of the handle 110A in the down or locked position, as shown in FIG. 9, the resilient arm 133 will press up against the lower surface of enlarged portion 125 of integral arm 123 to bias or maintain the shift handle and therefore the finger 130A in the locked position between the gear teeth of pinion gear 96. Furthermore, with the first or outer end 112A of the handle 110A in the upper or unlocked position, with the second or lower end 114A away from the pinion gear to remove the finger 130 from between the gear teeth, the enlarged portion 125 will move downwardly, past resilient arm 133. In this position, the biasing action of resilient arm 133 will press down on the top surface of enlarged portion to maintain the shift handle in the unlocked position.

It therefore can be seen that the modified shift mechanism 109 will be positively held in either the locked or the unlocked position by the action of the resilient arm 133 and the enlarged end 125 of integral arm 123.

In operation, the toy vehicle 10 is revved up, the motor locked by handle 110 or 110A, and the vehicle placed on the surface of track 18 of the jump 14, facing in the direction toward the tower 10, and, if used, the landing ramp 16. The pendulum motion of the hoop is started by the operator or user, and, at the proper moment, the outer end 112 or 112A of the shift handle 110 or 110A on the vehicle flipped or pushed upwardly, preferably by the finger of the user. This upward movement or shifting releases the pinion gear 96 thereby allowing the vehicle to accelerate under the power of the spring drive motor. As the vehicle gains speed, it will leave the end of the jump 14, and if properly timed, pass through the opening 22 in the swing hoop 24, and then land on the surface 17, or the landing ramp 16. The height of the jump 14 may be adjusted, as described above, to vary the height and length of the jump of the vehicle. In this manner, the user may continuously change the placement of the tower 12, the speed of the swinging pendulum hoop and, if used, the placement of the landing ramp 16. Therefore, depending on the height setting of the jump ramp, the estimated speed of the vehicle when it leaves the jump ramp, and the placement of the other elements, the play options and setups available to the user are greatly increased.

While the invention has been shown and described as a combination of the elements specifically described above, it is to be understood that various other adaptations and modifications may be made within the spirit and scope of the invention, without limiting the same.

We claim:

1. In combination:

a toy vehicle having a spring wound motor to move said vehicle and a shift mechanism for locking and unlocking said motor;

an adjustable-height jump cooperating with said toy vehicle to direct its path when said vehicle is placed thereon with said motor wound and said shift mechanism is released to allow said vehicle to move along said jump; and a tower having swingably mounted therein a pendulum-action hoop, said hoop having an opening therein spaced from said adjustable-height jump whereby said vehicle moving along and leaving said jump may pass through said opening when said hoop is swinging within said pendulum tower, provided that the speed of the toy vehicle, the height of the adjustable jump, and the swinging action of the pendulum hoop are properly timed and coordinated after the release of said shifting mechanism.

2. The combination of claim 1 wherein said shift mechanism of said toy vehicle comprises a handle having two ends, with an extending finger portion at one end and a shifting means at the other end, and further including a pivot means between said ends, said pivot means pivoted about a pivot point held to the upper surface of said spring drive motor whereby said extending finger portion may be moved to lock or unlock said motor.

3. The combination of claim 2 wherein said shift mechanism includes positive holding means to maintain said shift means in either the locked or unlocked position.

4. The combination of claim 1 wherein said adjustable-height jump comprises a flexible section of track and a ramp having a lower end and an elevated end with an enlarged upper surface connecting said lower end and said elevated end, said flexible track section having an open channel fixed to the lower surface thereof, with said enlarged upper surface of said ramp being inserted therein, whereby said flexible track section and said ramp may be moved relative to each other to thereby adjust the height of said jump.

5. The combination of claim 1 wherein said tower comprises a top having a plurality of legs fixed thereto with said pendulum-action hoop resiliently held in said top, said pendulum-action hoop including a lower hoop portion with said opening formed therein and a flame design imprinted about said opening, said pendulum, upon actuation, oscillating between said legs whereby said moving hoop appears to be a flaming stunt hoop through which a toy vehicle may pass.

6. The combination of claim 1 further including a landing ramp spaced from said jump and placed after said tower, whereby said toy vehicle, after it passes through said opening in said hoop will land on said landing ramp.

7. The combination of claim 6 wherein said shift mechanism of said toy vehicle comprises a handle having two ends, with an extending finger portion at one end and a shifting means at the other end, and further including a pivot means between said ends, said pivot means pivoted about a pivot point held to the upper surface of said spring drive motor whereby said extending finger portion may be moved to lock or unlock said motor.

8. The combination of claim 6 wherein said adjustable-height jump comprises a flexible section of track and a ramp having a lower end and an elevated end with an enlarged upper surface connecting said lower end and said elevated end, said flexible track section having an open channel fixed to the lower surface thereof, with said enlarged upper surface of said ramp being inserted therein, whereby said flexible track section and said ramp may be moved relative to each other to thereby adjust the height of said jump.

9. The combination of claim 6 wherein said tower comprises a top having a plurality of legs fixed thereto with said pendulum-action hoop resiliently held in said top, said pendulum-action hoop including a lower hoop portion with said opening formed therein and a flame design imprinted about said opening, said pendulum, upon actuation, oscillating between said legs whereby said moving hoop appears to be a flaming stunt hoop through which a toy vehicle may pass.

* * * * *